United States Patent [19]

Fisher et al.

[11] 4,266,628

[45] May 12, 1981

[54] DIFFERENTIAL CASE AND PUSH-FRAME ASSEMBLY

[75] Inventors: George A. Fisher; Gary E. Mason, both of Joliet, Ill.

[73] Assignee: Caterpillar Tractor Co., Peoria, Ill.

[21] Appl. No.: 69,449

[22] Filed: Aug. 24, 1979

Related U.S. Application Data

[62] Division of Ser. No. 822,843, Aug. 8, 1977, Pat. No. 4,183,551.

[51] Int. Cl.[3] ..... B60K 1/00

[52] U.S. Cl. ..... 180/54 F; 37/126 R; 37/129; 180/75; 180/88; 180/291; 180/312; 280/785; 280/481

[58] Field of Search ..... 180/75, 89.1, 88, 54 F, 180/312; 280/785, 481; 37/124, 126, 127, 128, 129

[56] References Cited

U.S. PATENT DOCUMENTS

| | | | |
|---|---|---|---|
| 2,280,696 | 4/1942 | French | 280/481 |
| 2,368,196 | 1/1945 | Brodersen | 37/126 AB |
| 2,888,999 | 6/1959 | Maruhn | 180/54 F |
| 3,462,859 | 8/1969 | Hawk | 37/126 R |
| 3,465,458 | 9/1969 | Wagner | 37/126 R |
| 3,471,952 | 10/1969 | Peterson | 37/126 R |
| 3,962,804 | 6/1976 | Hyler | 37/126 AB |

FOREIGN PATENT DOCUMENTS

| | | | |
|---|---|---|---|
| 693185 | 6/1953 | United Kingdom | 37/126 A |

*Primary Examiner*—John P. Silverstrim
*Attorney, Agent, or Firm*—Claude F. White

[57] ABSTRACT

A push frame assembly for a scraper bowl is provided with a tubular structural member extending between, and being rigidly fastened directly to, the side walls of the push frame. A push block and a spreader tube are, likewise, connected between the side walls to produce a relatively rigid frame assembly. In one form of the invention, the tubular structural member has a transverse sleeve therethrough through which an ejector cylinder passes, while in another form of the invention, the tubular structural member has provision for receiving a differential and has reinforced mounts on the one side thereof for connection of ejector cylinders thereto. A method of making a push frame assembly is provided wherein a pair of side walls are fastened directly to a tubular member with a spreader tube and a push block framework connected to the side walls to produce a stronger push frame assembly.

3 Claims, 10 Drawing Figures

DIFFERENTIAL CASE AND PUSH-FRAME ASSEMBLY

This is a division of Ser. No. 822,843, filed Aug. 8, 1977, now U.S. Pat. No. 4,183,551.

BACKGROUND OF THE INVENTION

1. Field of the Invention

This invention relates to a tractor scraper vehicle and, more particularly, to an improved construction for the push frame assembly for the scraper bowl and a method of making same.

2. Description of the Prior Art

The push frame for the scraper bowl of a tractor scraper combination has traditionally been a series of subassemblies which are welded and bolted together including a plurality of struts and trusses and various welded reinforcing plates and gussets. In single-engine tractor scrapers, the wheel mounting plates are built into the push frame side rails with the side rails of the push frame being tied together by several cross beams and plates. In double-engine tractor scrapers, a box-like subassembly is mounted between the side rails of the push frame, which structure acts as the differential case, whereby, an engine mounted on the push frame is connected to the differential in the case for driving the wheels attached to axle housings bolted to mounting plates on the box-like subassembly.

The box-like subassemblies have brackets which, in turn, are welded or bolted to the side rails of the framework of the push frame. The connections between the wheel mounting plates and the side rails and between the box-like structure and the brackets and the side rails can become loose or can fail, but, more than likely, because of the tortuous path the loads must follow in passing from the scraper bowl to the side rails, to the brackets, to the mounting plates or box-like structure and to the wheels, twisting, distortion and stress concentrations are produced resulting in structural failures.

SUMMARY OF THE INVENTION

The present invention is directed to overcoming one or more of the problems as set forth above.

An improved push frame assembly is provided which includes a tubular structural member extending between the side walls of the push frame. The side walls of the push frame are spaced apart and are welded to the tubular member and appropriate crossbraces are provided at the push end portion of the frame. A spreader tube assembly is connected to upwardly extended portions of the side walls of the frame at a location remote from the push end portion of the frame, the lower portions of the side walls of the frame have forwardly extending legs which are adapted to be welded to the bowl bottom of the tractor scraper combination.

In the case of a single-engine tractor scraper, the tubular member serves as the mount for the axle housings for the wheels and a sleeve is welded in the cross-tube and extends transversely to the axis of the tubular member through which sleeve an actuating cylinder for the bowl ejector passes. In the case of a two-engine tractor scraper, the tubular member serves as an engine mount and as a differential case so that the driveline from the engine passes into the differential in the tubular member whereupon a driving force is transmitted through axles to the wheels mounted on the axle housings on the outer portions of the tubular member.

Brackets for the actuators for the bowl ejector are mounted on the forward portion of the tubular member and are reinforced within the tubular member so as to provide a solid assembly.

The improved construction has the vertical loads from the bowl passing directly through the side walls of the push frame into the tubular member and to the wheels. The tubular member is a structural member which supports the wheel loads and is securely welded directly to the push frame and side walls and, therefore, becomes an integral part of the push frame. Since the tubular member is the basic element of the design, a stronger overall design results, which eliminates many of the prior art stress concentrations. The resulting push frame has a better appearance and is much easier to assemble.

The method of making the push frame assembly entails the steps of assembling the tubular member to the side walls of the frame and to the spreader tube, along with the structural cross members and braces. Axle housings are mounted on the flanges on the ends of the tubular member to which axle housings the wheels and brakes of the scraper are mounted.

BRIEF DESCRIPTION OF THE DRAWINGS

The details of construction and operation of the invention are more fully described with reference to the accompanying drawings which form a part hereof and in which like reference numerals refer to like parts throughout.

In the drawings.

DESCRIPTION OF THE PREFERRED EMBODIMENT

Figure 1:
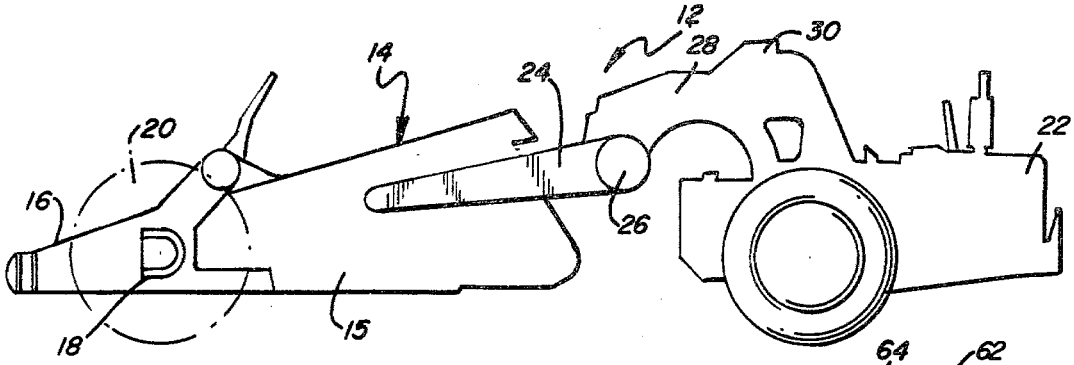
FIG. 1 is a side elevational view of a single-engine tractor scraper incorporating the improved push frame assembly.

A tractor scraper vehicle 12 has a bowl assembly 14 which includes a bowl 15 and a push frame assembly 16 rigidly attached together. The push frame 16 has a tubular structural member 18 which provides support for a pair of rear wheels 20. The bowl assembly 14 is drawn by a tractor 22 through a pair of draft arms 24 which extend on opposite sides of the bowl 15. The forward ends of the draft arms 24 are attached to a spreader tube 26 which is coupled to the tractor 22 by a gooseneck 28 and swivel hitch 30.

Referring to FIGS. 2 through 5, inclusive, the tubular structural member 18 is comprised of a body portion 32 which, in the illustrated form, is D-shaped in cross section having a rearwardly facing flat portion 33 and a semi-cylindrically shaped front portion 34 joined with said flat portion 33 by top and bottom tangential planes 35 and 36, respectively. Each side wall 37 and 38 is provided with a body portion 39 having a D-shaped aperture 31 therethrough with a rearwardly extending push end portion 40, a forwardly and upwardly angled support portion 41 and a forwardly extending leg portion 42 spaced from said support portion 41. The side walls 37,38 are welded to the body portion 32 of the tubular member 18 near the outer end portions thereof with the open ends of the tubular member 18 extending through the apertures 31 in said walls 37,38.

Figure 2:
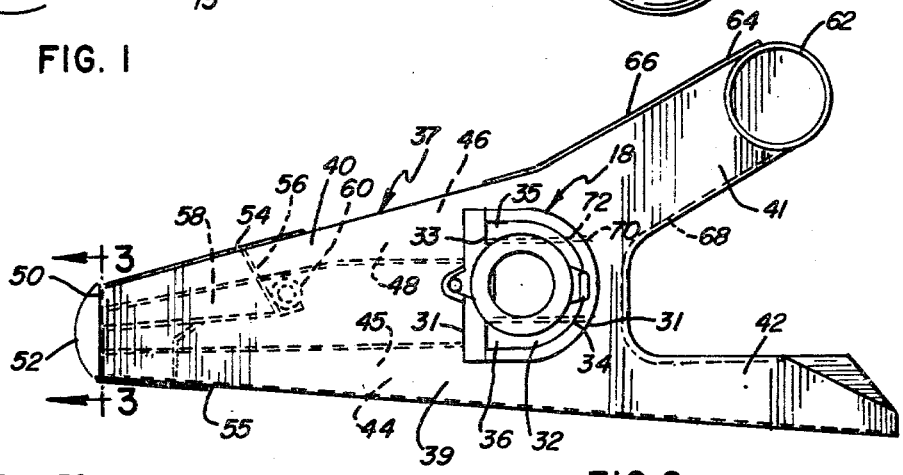
FIG. 2 is an enlarged elevational view of a push frame assembly incorporating one version of the invention.
Figure 3:
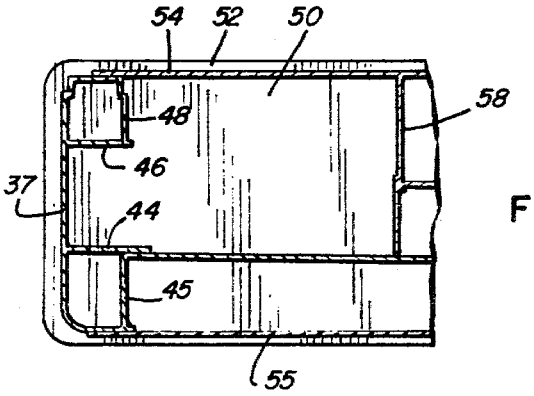
FIG. 3 is a partial cross-sectional view taken along the line 3—3 of FIG. 2.
Figure 4:
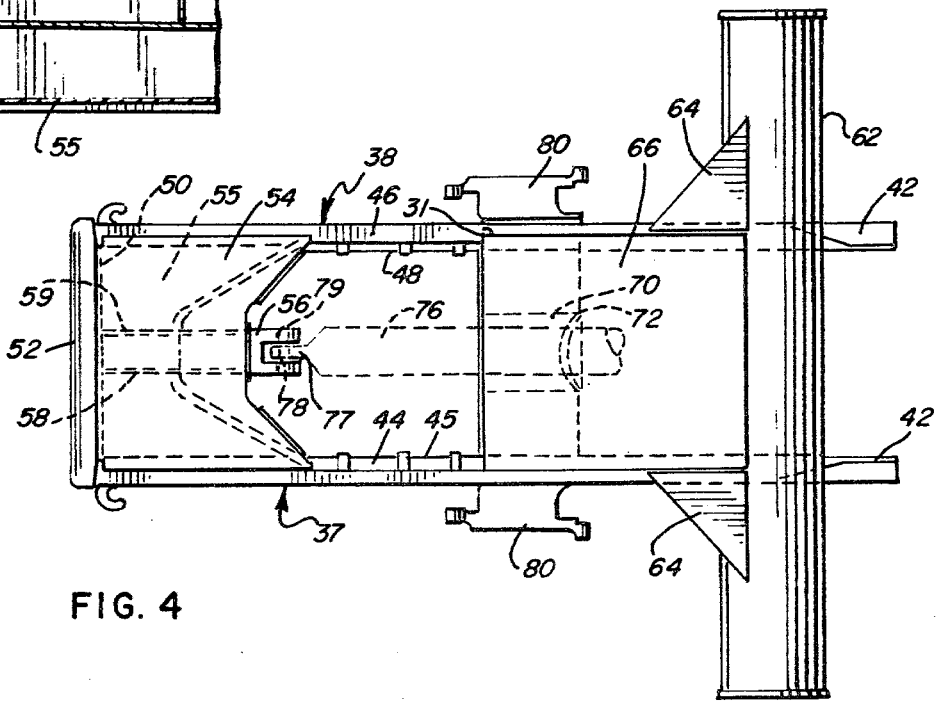
FIG. 4 is a partial plan view of the push frame assembly of FIG. 2.
Figure 5:
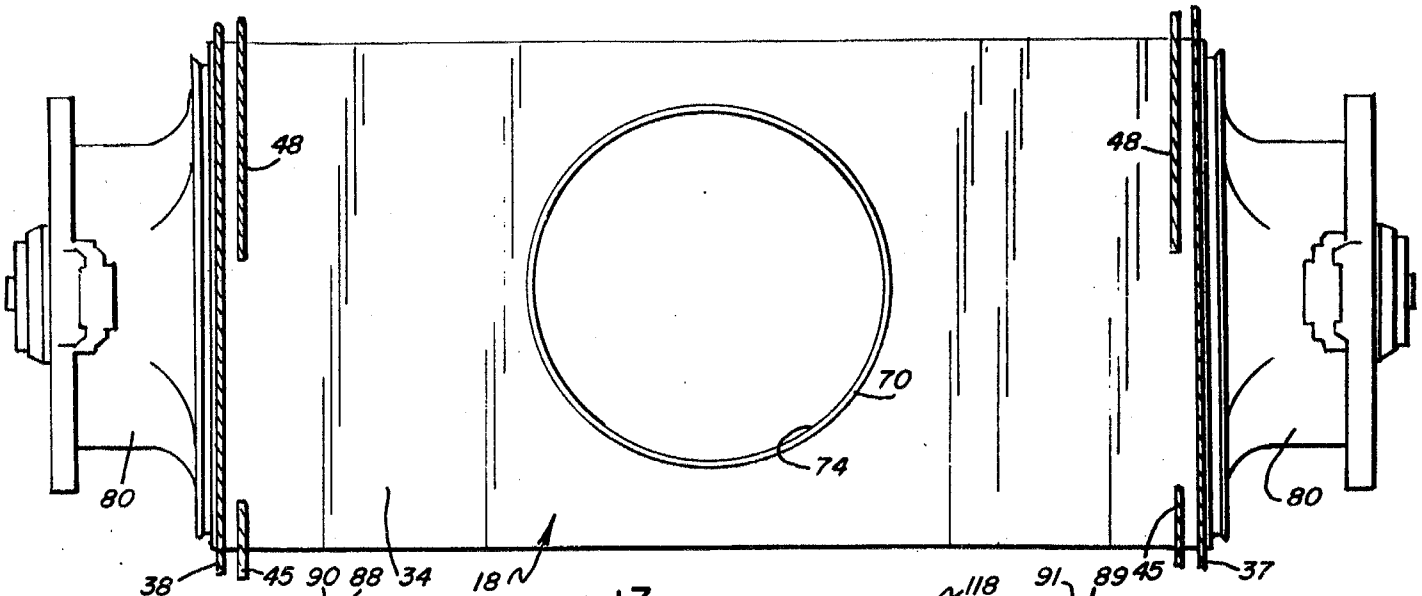
FIG. 5 is an elevational view of the tubular structural member for the non-rear engine scraper of FIGS. 2 through 4.
Figure 6:
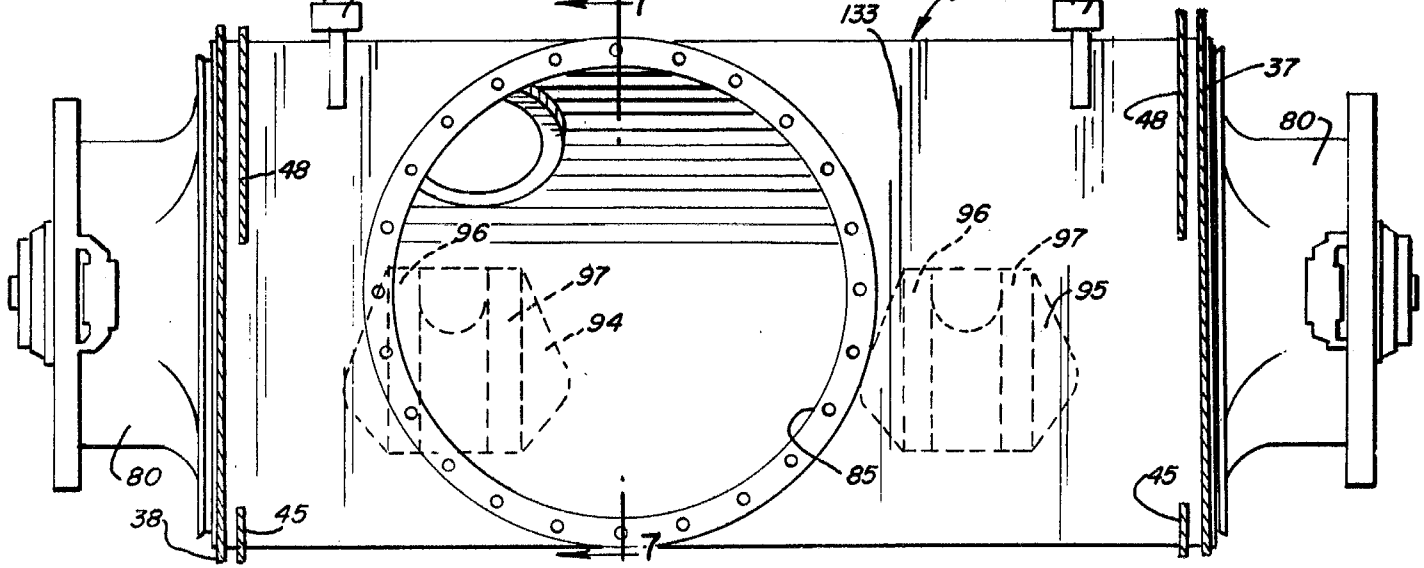
FIG. 6 is an elevational view similar to FIG. 5, only showing a form of tubular structural member for a rear engine scraper.
Figure 8:
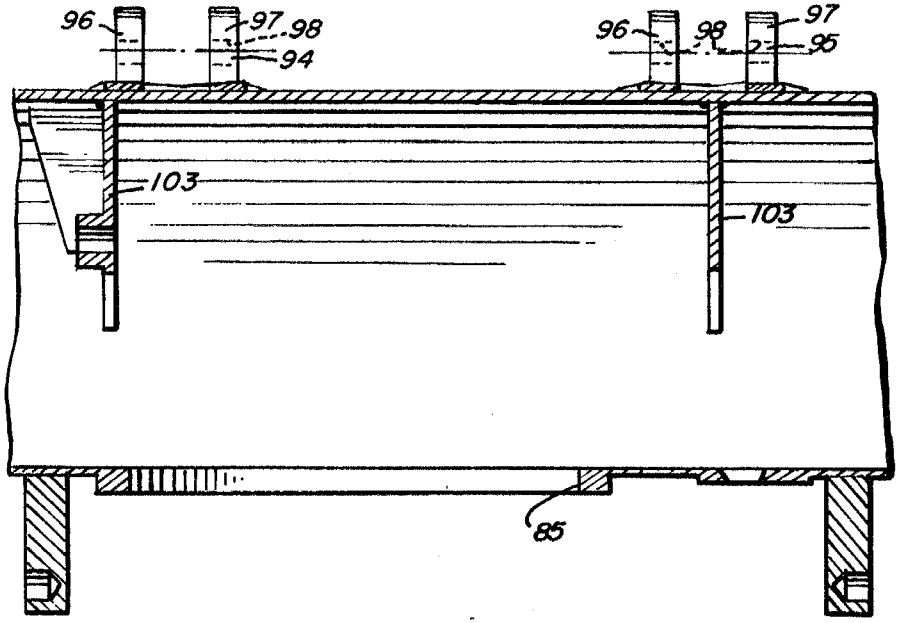
FIG. 8 is a partial cross-sectional view taken along the line 8—8 of FIG. 9.

As shown in FIG. 3, a corner rail 44, which is box shape in cross section, is assembled with the lower edge of the side wall 37 and runs along the lower edge portion thereof. The inner wall 45 of the rail 44, as shown in FIG. 2, is welded to the lower corner of the tubular member 18. An upper corner rail 46 is formed on and secured to the upper inner edge of the side wall 37 with the inner wall 48 of said corner rail 46 being welded to the upper corner of the tubular member 18. Comparable corner rails are provided for side wall 38. The walls 45 and 48 of the corner rails 44,46, respectively, are welded to the tubular member 18 across the bottom and top, respectively, and around the front portion 34, becoming one wall forward of said member 18. A U-shaped front wall 68 is welded between the side wall 37 and the wall 45 of the corner rail 44 and follows the U-shaped opening between the leg 42 and the support portion 41 where it is welded between the side wall 37 and the wall 48 of the side rail 46. A comparable wall 68 is welded between the side wall 38 and the walls 45 and 48 of the rails 44,46.

An end plate 50 extends between the push end portions 40 of the side walls 37,38 and is welded to said side walls 37,38 and to the edges of the corner rails 44, 46 on each side of the push frame 16. A push block 52 is secured to the end plate 50 and is adapted to be contacted by following vehicles, such as a pusher tractor, or the like. A shaped top wall 54 and bottom wall 55 extend between the corner rails 46 and 44, respectively, of the push end portion 40 of the side walls 37,38 and are rigidly attached, as by welding, or the like. The top and bottom walls 54,55 are also welded to the end plate 50. An angled plate 56 is welded to the top wall 54 near the midportion of the space between the side walls 37,38, which plate 56 is braced against the end plate 50 by a pair of parallel plates 58,59. A bifurcated bracket 60 is secured to the plate 56 with the arms of the bracket facing toward the tubular member 18.

A spreader tube 62 extends between the upwardly angled support portions 41 of the side walls 37,38 and is rigidly welded thereto. The spreader tube 62 extends beyond the outer surfaces of the spaced side walls 37,38 and is adapted to be connected to the upper rear portions of the bowl 15 of the bowl assembly 14. Triangular reinforcing plates 64 are welded to the top of the spreader tube 62 and the top surfaces of the walls 37,38. A forward top wall 66 is welded to the spreader tube 62 and to the corner rails 46,46.

A sleeve 70 is welded in aligned apertures 72,74 formed in the shaped front portion 34 and the flat back portion 33 of the tubular member 18 with the axis of the sleeve lying transverse to the longitudinal axis of the tubular member 18. The sleeve 70 is substantially centered between the side walls 37,38 of the push frame 16. An ejector cylinder 76, for the ejector mechanism of the bowl assembly 14, extends through the sleeve 70 in the tubular member 18 with the rear end of the cylinder 76 having an apertured extension 77 with the aperture 78 in the extension aligning with a pair of aligned apertures 79 in the bifurcated bracket 60 secured to the plate 56. The other end of the ejector cylinder 76 is connected to the ejector mechanism (not shown) for use in moving the load in the bowl 15 forward and out the discharge opening in the bowl.

The tubular member 18 has a pair of axle flanges 80 fastened in the open, outwardly facing opposite ends thereof, which flanges 80 serve to space the wheels 20 outwardly from the push frame 16.

The wheel-mounting and brake assembly for each wheel 20 is bolted by a plurality of studs to the outer surface of the wheel flanges 80. The connection and operation of the wheels and brakes are conventional and will not be described in detail herein.

Referring to FIGS. 6 through 10, wherein a second modification of the invention is illustrated, the construction of the push frame is substantially the same with the exception that a tubular member 118 is provided having a different configuration than the tubular member 18. That is, the embodiment of FIGS. 6 through 10 is for use with a two-engine tractor scraper, where one engine is mounted in the rear on the push frame. Specifically, in FIGS. 6 and 7, the tubular member 118 has an enlarged opening 85 formed through a substantially flat rear portion 133 thereof. An opening 85 in the tubular member 118 is offset to one side from the center of the tube. A pair of engine mounts 88,89 are welded to the top surface of the tubular member 118, which mounts have relatively large planar surfaces 90,91 facing upwardly therefrom to which the rear engine (not shown) is rigidly attached.

With the engine in place, the driveline from the engine extends in a circuitous path into alignment with the opening 85 into the tubular member 118, which tubular member 118 serves as a differential housing or case. A differential (not shown) for driving the wheels 20 on the bowl assembly 14 is mounted in the tubular member 118 with axles (not shown) extending outwardly from the opposite ends of the tubular member. Wheel flanges 80 are rigidly mounted in the open ends of the tubular member 118, which wheel flanges have a plurality of stud openings 93 for securing the wheel drive and brake assembly thereto. The axles from the differential extend through the wheel flanges 80 and are connected to the wheels 20 for driving the wheels 20 in a conventional fashion.

Figure 10:
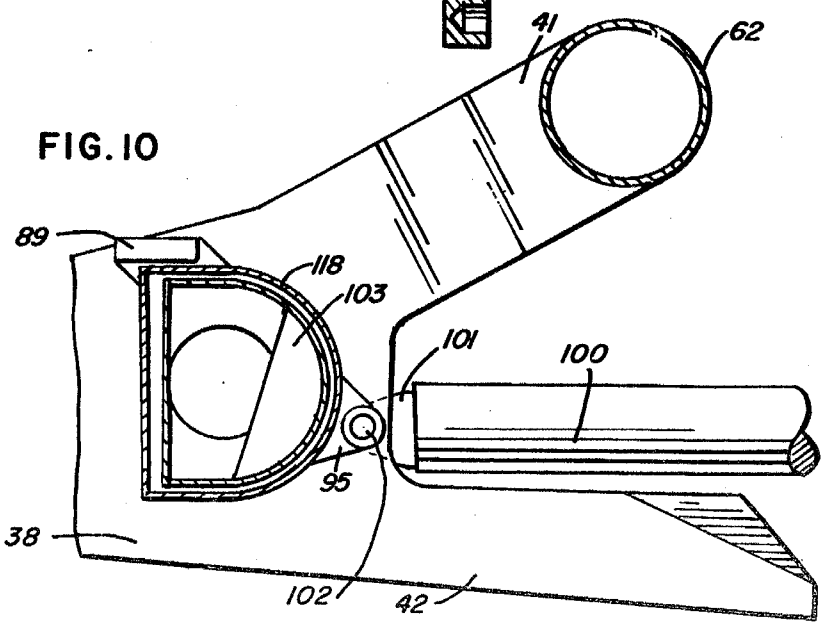
FIG. 10 is a partial elevational view of a push frame assembly incorporating the tubular structural member of FIG. 6 with an ejector cylinder connected thereto.
Figure 7:
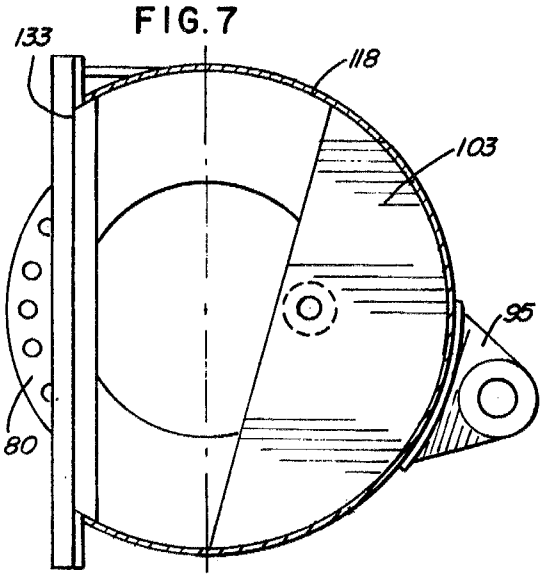
FIG. 7 is a cross-sectional view taken along the line 7—7 of FIG. 6.
Figure 9:
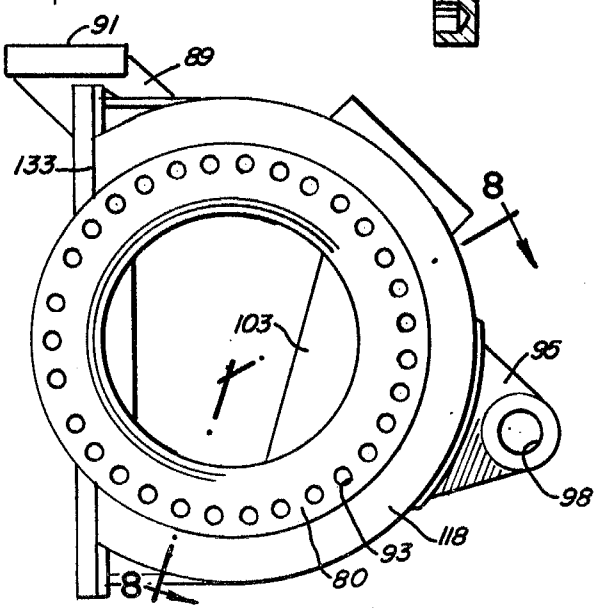
FIG. 9 is an end-elevational view of the tubular structural member of FIG. 6.

Mounted on the lower forward surface of the tubular member 118 are a pair of spaced apart bifurcated mounting brackets 94,95. Each mounting bracket has a forwardly projecting pair of spaced plates 96,97 with aligned apertures 98 passing through the outer end portions thereof. As shown in FIG. 10, two actuator cylinders 100 for the ejector mechanism are connected by means of a plate 101 on the rear of the cylinder extending between the bifurcated plates 96,97 of the brackets 94,95 with a pivot pin 102 passing therethrough so that the cylinders 100 have a rigid support. When actuated, the cylinders 100 will positively drive the material in the bowl 14 forward and out the appropriate discharge opening therein. To brace and support the brackets 94,95, semi-circular support braces 103 are provided on the inside of the tubular member 118. The support braces 103 are welded on the inner surface of the tube and are located centrally in line with the midportions of the brackets 94,95 carried on the outer forward surface of the tubular member 118. The support braces 103 are located in such a way with respect to the differential case as to prevent any interference with the differential and/or axles extending therefrom.

From the above, it can be seen that there is provided a push frame 16 for a bowl assembly 14 wherein a tubular member 18 is rigidly connected directly to the opposite walls of the push frame 16 which, when combined with the spreader tube 62 connected between the side walls 37,38 and the push block 52 for the push end portion 40 thereof, produces a structurally sound push frame. The tubular member 18 is a structural member which supports the wheel loads and, being securely welded to the frame, becomes an integral part of the frame and reduces the twisting loads going into the side walls of the push frame. This construction creates a stronger overall push frame which eliminates many stress concentrations. The resulting push frame has a better appearance and is easier to assemble.

The method of assembling the push frame 16 has, as one of the key elements, the tubular member 18,118 which is first welded to the edges of the apertures 31 in the side walls 37,38 at the opposite end portions of the tubular member by means of spacer plates. An end plate 50 and a push block 52 are then rigidly attached to the push end portion 40 of the side walls 37,38. Top and bottom walls 54,55 are welded to the side walls 37,38 at the push end portion 40 thereof. A spreader tube 62 is rigidly mounted by means of welding or the like, to the upwardly extending portions 41 of the side walls 37, 38. A second top wall 66 is welded to the spaced upward portions 41. The push frame assembly 16 for use with single-engine tractor scrapers will have the tubular member with a sleeve 70 extending transversely therethrough and a plate 56 will be welded to braces 58,59 which, in turn, are welded to the top wall 54 and the rear plate 50 to support a bracket 60. An ejector cylinder 76 for the ejector mechanism is connected to the bracket 60 and passes through the sleeve 70 in the member 18. In the case of a dual-engine tractor scraper, the push frame 16 is provided with a tubular member 118 which has engine mounts 88,89 on the upper surface thereof and which tubular member 118 also has an opening 85 for receiving the output from an engine. A differential is mounted in the tubular member 118, which differential is connected to said engine output and to the rear wheels 20 on the bowl assembly. A pair of brackets 94,95 are secured to the front of the tubular member 118 for anchoring one end of a pair of ejector cylinders 100 for the ejector mechanism. Reinforcing braces 103 are secured in the tubular member 118 behind the brackets 94,95 to support the load on said brackets. The forwardly extending lower legs 42 of the side walls 37,38 are adapted to be welded or otherwise secured to the bottom of the bowl 15 of the bowl assembly 14.

The embodiment of the invention in which an exclusive property or privilege is claimed is defined as follows:

1. A push frame assembly for a scraper bowl comprising: a tubular structural member, a pair of spaced apart side walls, each side wall having an aperture therethrough, said tubular member structurally spanning the distance between said spaced apart said walls, the opposite end portions of said tubular member extending through said apertures and being structurally connected directly to said side walls, a spreader tube connected directly to upwardly projecting portions of said spaced apart side walls, a rear plate connected directly to portions of the side walls remote from said spreader tube, said tubular member having a rearwardly facing engine drive line receiving opening there-through, bracket means including two brackets connected to the front of said tubular member to which two ejector cylinders are adapted to be connected, and engine support mounts secured to the top surface of said tubular member for supporting an engine.

2. In a push frame assembly for a scraper bowl, a D-shaped tubular structural member, a pair of spaced apart side walls, each side wall having a D-shaped aperture therethrough, the opposite end portions of said tubular member extending through said apertures and being connected directly to said side walls, a spreader tube extending between and being connected to an upwardly projecting portion of said spaced apart side walls, a rear plate connecting portions of the side walls remote from said spreader tube, the flat portion of said tubular member facing in the direction of said rear plate, said tubular member having an opening in said flat portion, engine support mounts mounted on the upper portion of said tubular member, a pair of brackets connected to the curved portion of said tubular member, said brackets being adapted to pivotally receive one end of a pair of ejector cylinders, and an axle flange secured in each end of said tubular member and projecting outwardly from the side walls whereby axle housings of a pair of wheels are secured to said axle flanges so that forces on the push frame act through said tubular member directly to the wheels.

3. A method of making a push frame assembly for a scraper bowl comprising the steps of:

welding the opposite end portions of a tubular structural member into aligned apertures in a pair of spaced apart side walls;

welding a spreader tube assembly to an upwardly projecting portion of each of said spaced apart side walls;

welding a rear plate to spaced apart portions of said side walls remote from said spreader tube;

welding a top wall between said remote portions of said side walls and said rear plate;

welding reinforcing plates between said spreader tube and said upwardly projecting portions of said side walls;

welding axle flanges in the ends of said tubular members and projecting outwardly from said side walls for mounting wheels on said flanges;

welding two ejector cylinder supporting brackets to the front of said tubular member; and welding engine mounts to the upper portion of said tubular member.

* * * * *